US011328663B2

(12) United States Patent
Qian et al.

(10) Patent No.: US 11,328,663 B2
(45) Date of Patent: May 10, 2022

(54) PIXEL DRIVING CIRCUIT, DRIVING METHOD THEREOF, AND DISPLAY DEVICE

(71) Applicants: Hefei Xinsheng Optoelectronics Technology Co., Ltd., Anhui (CN); BOE Technology Group Co., Ltd., Beijing (CN)

(72) Inventors: Xianrui Qian, Beijing (CN); Fei Li, Beijing (CN); Bo Li, Beijing (CN); Yuting Chen, Beijing (CN); Zixuan Wang, Beijing (CN)

(73) Assignees: Hefei Xinsheng Optoelectronics Technology Co., Ltd., Hefei (CN); BOE Technology Group Co., Ltd., Beijing (CN)

( * ) Notice: Subject to any disclaimer, the term of this patent is extended or adjusted under 35 U.S.C. 154(b) by 119 days.

(21) Appl. No.: 16/339,565

(22) PCT Filed: Sep. 28, 2018

(86) PCT No.: PCT/CN2018/108434
§ 371 (c)(1),
(2) Date: Apr. 4, 2019

(87) PCT Pub. No.: WO2019/085702
PCT Pub. Date: May 9, 2019

(65) Prior Publication Data

US 2021/0012709 A1 Jan. 14, 2021

(30) Foreign Application Priority Data

Oct. 30, 2017 (CN) ..... 201711034231.4

(51) Int. Cl.
*G09G 3/3233* (2016.01)

(52) U.S. Cl.
CPC ... *G09G 3/3233* (2013.01); *G09G 2310/0264* (2013.01); *G09G 2320/0233* (2013.01); *G09G 2320/043* (2013.01); *G09G 2330/021* (2013.01)

(58) Field of Classification Search
CPC ..... G09G 3/3233; G09G 2320/0233; G09G 2310/0264; G09G 2330/021; G09G 2320/043
See application file for complete search history.

(56) References Cited

U.S. PATENT DOCUMENTS 9,940,878 B2 * 4/2018 Liang ..... G09G 3/3258
10,339,865 B2 * 7/2019 Chen ..... G09G 3/3291
(Continued)

FOREIGN PATENT DOCUMENTS

CN 1231046 A 10/1999
CN 101937647 A 1/2011
(Continued)

OTHER PUBLICATIONS

Chinese Office Action dated Mar. 21, 2019, from application No. 201711034231.4.
(Continued)

*Primary Examiner* — Jeff Piziali
(74) *Attorney, Agent, or Firm* — Arch & Lake LLP

(57) ABSTRACT

The present disclosure provides a pixel driving circuit, a driving method thereof, and a display device, and relates to the field of display technology. The pixel driving circuit includes a first driver, a second driver, and a light emitting element. The first driver is configured to generate a first driving current. The second driver is configured to generate a second driving current. The first driving current and the second driving current alternately drive the light emitting element as a main driving current.

11 Claims, 3 Drawing Sheets

(56) References Cited

U.S. PATENT DOCUMENTS

| | | | | |
|---|---|---|---|---|
| 10,529,277 | B2 * | 1/2020 | Lee | G09G 3/3225 |
| 2016/0189604 | A1 * | 6/2016 | Hu | G09G 3/3225<br>345/215 |
| 2017/0110056 | A1 | 4/2017 | Hu | |
| 2017/0162125 | A1 * | 6/2017 | Liang | G09G 3/3233 |
| 2017/0193910 | A1 | 7/2017 | Chen et al. | |
| 2017/0263184 | A1 * | 9/2017 | Chen | G09G 3/3233 |

FOREIGN PATENT DOCUMENTS

| | | | |
|---|---|---|---|
| CN | 102881262 | A | 1/2013 |
| CN | 103413519 | A | 11/2013 |
| CN | 104021763 | A | 9/2014 |
| CN | 104599634 | A | 5/2015 |
| CN | 104732929 | A | 6/2015 |
| CN | 105047137 | A | 11/2015 |
| CN | 105139805 | A | 12/2015 |
| CN | 205080892 | U | 3/2016 |
| CN | 206021875 | U | 3/2017 |
| CN | 104021763 | B | 12/2017 |
| CN | 107731163 | A | 2/2018 |
| KR | 20110071983 | A | 6/2011 |
| KR | 101557289 | B1 | 10/2015 |
| WO | WO-2015/188471 | A1 | 12/2015 |

OTHER PUBLICATIONS

Chinese Office Action dated May 27, 2019, from application No. 201711034231.4.

International Search Report and Written Opinion dated Dec. 29, 2018, from application No. PCT/CN2018/108434.

* cited by examiner

PIXEL DRIVING CIRCUIT, DRIVING METHOD THEREOF, AND DISPLAY DEVICE

CROSS REFERENCE TO RELATED APPLICATIONS

The present application is based upon International Application No. PCT/CN2018/108434, filed on Sep. 28, 2018, which claims the priority to the Chinese Patent Application NO. 201711034231.4, filed on Oct. 30, 2017, the entire contents of which are hereby incorporated by reference as a part of the present application.

TECHNICAL FIELD

The present disclosure relates to the field of display technology, and in particular, to a pixel driving circuit, driving method thereof, and display device.

BACKGROUND

Organic Light Emitting Diode (OLED), as a current-type light emitting device, is widely used in high-performance display fields due to its advantages of slimness, self-luminous, wide viewing angle, high definition, high brightness, fast response, and ability to be fabricated on flexible substrates. OLED display devices can be classified into two types: PMOLED (passive matrix driving OLED) and AMOLED (active matrix driving OLED). As the AMOLED display has the advantages of low manufacturing cost, low energy consumption, high response speed, wide operating temperature range, strong seismic resistance, DC drive for portable equipment and so on, AMOLED has been widely studied in the field of flat panel display.

SUMMARY

The present disclosure is to provide a pixel driving circuit, a pixel driving method, and a display device.

Other features and improvements of the present disclosure will be discussed in the following detailed description, or will be understood in part through the practice of the present disclosure.

According to an aspect of the present disclosure, there is provided a pixel driving circuit. The pixel driving circuit includes a first driver, a second driver, and a light emitting element coupled to both the first driver and the second driver. The first driver is configured to generate a first driving current. The second driver is configured to generate a second driving current. The first driving current and the second driving current alternately drive the light emitting element to be a main driving current.

In an exemplary arrangement of the present disclosure, when the first driving current is used as the main driving current, the first driving current is greater than the second driving current. When the second driving current is used as the main driving current, the second driving current is greater than the first driving current.

In an exemplary arrangement of the present disclosure, a driving current of the light emitting element is a sum of the first driving current and the second driving current.

In an exemplary arrangement of the present disclosure, when one of the first driving current and the second driving current drives the light emitting element as a main driving current, the other of the first driving current and the second driving current is taken as a compensation current to compensate for the one of the first driving current and the second driving current.

In an exemplary arrangement of the present disclosure, when the first driving current is used as the main driving current, a driving voltage of the first driver is greater than a driving voltage of the second driver. When the second driving current is used as the main driving current, the driving voltage of the second driver is greater than the driving voltage of the first driver.

In an exemplary arrangement of the present disclosure, the first driver includes a first switching element. The first switching element has a control terminal coupled to a scan signal terminal, a first terminal coupled to a first data signal terminal, and a second terminal coupled to a first node. The first switching element is configured to transmit a first data signal to the first node in response to a scan signal. The first driver includes a first driving transistor. The first driving transistor has a control terminal coupled to the first node, a first terminal coupled to a first power signal terminal, and a second terminal coupled to the light emitting element. The first driving transistor is configured to generate the first driving current and transmitted to the light emitting element under the action of the first node and a first power signal. The first driver includes a first storage device, connected between the first node and the first power signal terminal. In an exemplary arrangement of the present disclosure, the second driver includes a second switching element. The second switching element has a control terminal coupled to the scan signal terminal, a first terminal coupled to a second data signal terminal, and a second terminal coupled to a second node. The second switching element is configured to transmit a second data signal to the second node in response to the scan signal.

The second driver includes a second driving transistor. The second driving transistor has a control terminal coupled to the second node, a first terminal coupled to the first power signal terminal, and a second terminal coupled to the light emitting element. The second driving transistor is configured to generate the second driving current and transmit it to the light emitting element under the action of the second node and the first power signal. The first driver includes a second storage device connected between the second node and the first power signal terminal. In an exemplary arrangement of the present disclosure, the pixel driving circuit further includes a current detecting circuit. The current detecting circuit is coupled to the first power signal terminal and configured to detect the driving current flowing through the light emitting element.

A voltage of the first data signal and/or a voltage of the second data signal are adjusted according to the driving current. In an exemplary arrangement of the present disclosure, the current detecting circuit includes a current reading circuit configured to read a magnitude of the driving current. The current detecting circuit includes a detecting switching element. The detecting switching element has a control terminal coupled to the scan signal terminal, a first terminal coupled to the first power signal terminal, and a second terminal coupled to a current reading circuit. The detecting switching element is configured to transmit the driving current to the current reading circuit in response to the scan signal.

The other terminal of the current reading circuit is coupled to the second power signal terminal. In an exemplary arrangement of the present disclosure, the pixel driving circuit further includes a compensation circuit.

The compensation circuit is coupled to the current detecting circuit and configured to receive the driving current detected by the current detecting circuit. The compensation circuit is configured to adjust the voltage of the second data signal in a first stage according to the driving current, and adjust the voltage of the first data signal in a second stage.

In an exemplary arrangement of the present disclosure, the first and second driving transistors and the switching elements are either N-type transistors or P-type transistors.

In an exemplary arrangement of the present disclosure, the first storage device and the second storage device both include a capacitor. In an exemplary arrangement of the present disclosure, the light emitting element is an organic light emitting diode.

The other terminal of the light emitting element is coupled to a third power signal terminal.

According to an aspect of the present disclosure, there is provided a pixel driving method, configured to drive a pixel driving circuit including a first driver, a second driver, and a light emitting element coupled to both the first driver and the second driver. The pixel driving method includes generating a first driving current and transmitting it to the light emitting element by the first driver under an action of a first data signal and a first power signal. The pixel driving method includes generating a second driving current and transmitting it to the light emitting element by the second driver under an action of a second data signal and the first power signal. The first driving current and the second driving current alternately drive the light emitting element to be a main driving current.

In an exemplary arrangement of the present disclosure, when the first driving current is used as the main driving current, the first driving current is greater than the second driving current. When the second driving current is used as the main driving current, the second driving current is greater than the first driving current.

In an exemplary arrangement of the present disclosure, a driving current of the light emitting element is a sum of the first driving current and the second driving current.

In an exemplary arrangement of the present disclosure, when one of the first driving current and the second driving current drives the light emitting element as a main driving current, the other of the first driving current and the second driving current is taken as a compensation current to compensate for the one of the first driving current and the second driving current.

In an exemplary arrangement of the present disclosure, the pixel driving method further includes detecting the driving current flowing through the light emitting element. The driving current is obtained by adding the first driving current and the second driving current. The pixel driving method further includes adjusting a voltage of the second data signal in a first stage according to the driving current, and adjusting a voltage of the first data signal in a second stage.

In an exemplary arrangement of the present disclosure, adjusting a voltage of the second data signal in a first stage according to the driving current, and adjusting a voltage of the first data signal in a second stage includes keeping the voltage of the first data signal constant and adjusting the voltage of the second data signal in the first stage according to the driving current, so that the second driving current is used as a compensation current for the first driving current. Such an operation further includes keeping the voltage of the second data signal constant and adjusting the voltage of the first data signal in the second stage according to the driving current, so that the first driving current is used as the compensation current for the second driving current.

According to an aspect of the present disclosure, a display device including the above-described pixel driving circuit is provided.

It should be understood that the above general description and the following detailed description are merely exemplary and explanatory and is not a limiting of the present disclosure.

This section provides an overview of various implementations or examples of the techniques described in the present disclosure, and is not a full disclosure of the full scope or all features of the disclosed technology.

BRIEF DESCRIPTION OF THE DRAWINGS

The drawings, which are incorporated in the specification and constitute a part of the specification, show exemplary arrangements of the present disclosure and explain the principles of the present disclosure along with the specification. It is apparent that the drawings in the following description show only some of the arrangements of the present disclosure, and for those skilled in the art, other drawings can be obtained according to these drawings without any creative work.

DETAILED DESCRIPTION

Figure 1:
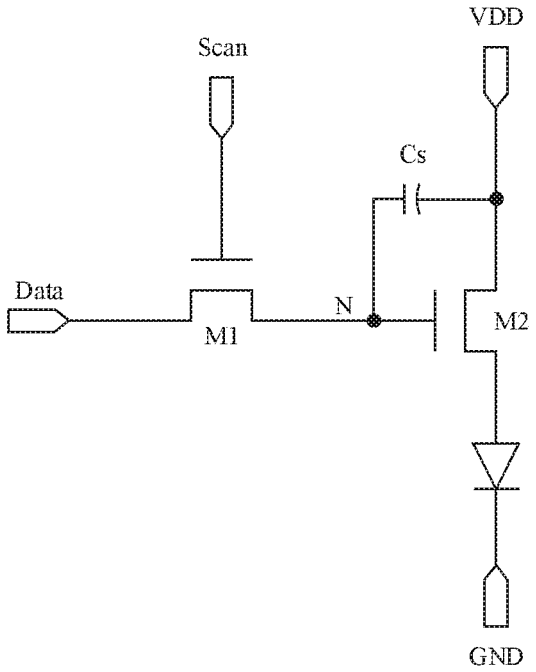
FIG. 1 is a schematic view showing a 2T1C structure of a pixel driving circuit.

Exemplary arrangements will now be described more fully with reference to the accompanying drawings. However, the arrangements can be implemented in a variety of forms and should not be construed as being limited to the examples set forth herein; rather, these arrangements are provided so that this disclosure will be more complete so as to convey the idea of the exemplary arrangements to those skilled in this art. The described features, structures, or characteristics in one or more arrangements may be combined in any suitable manner. In the following description, numerous specific details are set forth to provide a full understanding of the arrangements of the present disclosure. However, one skilled in the art will appreciate that the technical solutions of the present disclosure can be practiced when one or more of the described specific details may be omitted or other methods, components, devices, operations, etc. may be employed. In other cases, well-known technical solutions are not shown or described in detail to avoid obscuring aspects of the present disclosure.

In addition, the drawings are merely schematic representations of the present disclosure and are not necessarily drawn to scale. The thicknesses and shapes of the various layers in the drawings do not reflect the true scale, only for the convenience of the description of the present disclosure.

The same reference numerals in the drawings denote the same or similar parts, and the repeated description thereof will be omitted.

As shown in FIG. 1, a driving unit of an exemplary OLED pixel of the present disclosure at least adopts a 2-transistors-1-capacitor (2T1C) structure, that is, the 2T1C structure includes a switching transistor M1, a driving transistor M2, and a storage capacitor Cs. However, due to a series of defect states such as traps inside the transistor, a threshold voltage of the transistor may drift due to being in an operation state for a long time. For example, if the driving transistor is subjected to a large gate voltage for a long period of time, a large threshold voltage drift occurs, and the luminous intensity of the OLED pixel is in turn closely related to the threshold voltage of the driving transistor. Therefore, the threshold voltage drift of the driving transistor inevitably has a negative influence on the illuminating brightness of the OLED pixel and the service life of the product.

Based on the 2T1C structure of the OLED pixel driving unit shown in FIG. 1, in the practical application of the OLED product, the compensation logic circuit is generally used to compensate the threshold voltage of the driving transistor of the OLED. The more mainstream method is to add a transistor to directly perform threshold voltage compensation for the driving transistor. For example, the gate voltage of the driving transistor can be increased in real time to achieve threshold voltage compensation, therefore ensuring stable luminance. However, in such methods, as the time goes on, the threshold voltage drift phenomenon of the driving transistor will gradually become serious, therefore accelerating the aging process. Therefore, although such a compensation method can maintain a stable luminance, it may be to some extent damage the service life of the display product.

Figure 2:
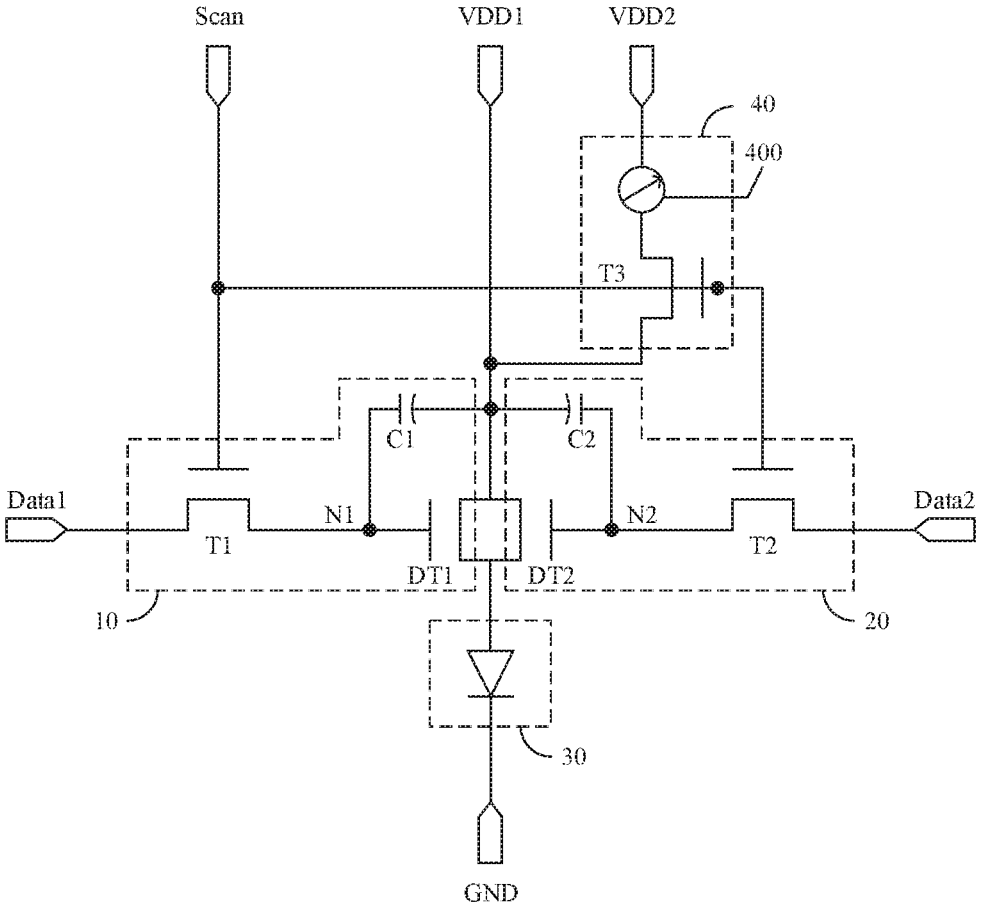
FIG. 2 is a schematic block diagram showing a structure of a pixel driving circuit in an exemplary arrangement of the present disclosure.

As shown in FIG. 2, the exemplary arrangement provides a pixel driving circuit including a first driving module 10, a second driving module 20, and a light emitting element 30 coupled to both the first driving module 10 and the second driving module 20.

In the arrangement, the first driving module 10 can be configured to generate a first driving current and transmit it to the light emitting element 30, the second driving module 20 can be configured to generate a second driving current transmit it to the light emitting element 30, and the first driving module 10 and the second driving module 20 are time-divisionally switched to serve as a main driving module for controlling the light emitting element 30 to emit light. That is, the first driving module 10 and the second driving module 20 are alternately used as a main driving module and a compensation module for controlling the light emitting elements 30 to emit light at different stages.

The pixel driving circuit provided by the exemplary arrangement of the present disclosure alternates the first driving module 10 and the second driving module 20 as the main driving circuit and the compensation circuit, so that real-time current compensation can be performed on the light emitting pixels. On the one hand, by providing a stable driving current for the light emitting element 30, the stability and uniformity of the luminance can be ensured, therefore improving the display quality of the display device; on the other hand, by alternately using the two driving modules as the main driving circuit, the threshold voltage drift problem of the driving transistor can be fundamentally solved, therefore prolonging the service life of the display product.

In this exemplary arrangement, the first driving module 10 may include a first switching element T1 having a control terminal coupled to a scan signal terminal Scan, a first terminal coupled to a first data signal terminal Data1, and a second terminal coupled to a first node N1, and configured to respond to a scan signal to transmit a first data signal to the first node N1. The first driving module 10 may include a first driving transistor DT having a control terminal coupled to the first node N1, a first terminal coupled to a first power signal terminal VDD1, and a second terminal coupled to the light emitting element 30. The first driving transistor DT is configured to generate the first driving current and transmit it to the light emitting element 30 under the action of the first node N1 and a first power signal VDD1. The first driving module 10 may include a first storage unit C1 connected between the first node N1 and the first power signal terminal VDD1 and configured to store a voltage signal of the first node N1.

In this exemplary arrangement, the second driving module 20 may include a second switching element T2 having the control terminal coupled to the scan signal terminal Scan, the first terminal coupled to the second data signal terminal Data2, and the second terminal coupled to the second node N2. The second driving module 20 is configured to transmit the second data signal to the second node in response to the scan signal N2. The second driving module 20 may include a second driving transistor DT2 having the control terminal coupled to the second node N2, the first terminal coupled to the first power signal terminal VDD1, and the second terminal coupled to the light emitting element 30. The second driving transistor DT2 is configured to generate the second driving current and transmitted to the light emitting element 30 under the action of the second node N2 and the first power signal. The second driving module 20 may include a second storage unit C2 connected between the second node N2 and the first power signal terminal VDD1 and configured to store the voltage signal of the second node N2.

In the arrangement, the first storage unit C1 and the second storage unit C2 may both be storage capacitors.

In this arrangement, the first driving transistor DT1 and the second driving transistor DT2 may alternately be used as a main driving transistor and a compensation transistor at different stages. That is, at the current stage, the first driving transistor DT1 is used as the main driving transistor, and the second driving transistor DT2 is used as the compensation transistor; while in the next stage, the second driving transistor DT2 is used as the main driving transistor, and the first driving transistor DT1 is used as the compensation transistor.

In this way, the first driving current generated by the first driving transistor DT1 and the second driving current generated by the second driving transistor DT2 can be used together as a driving current for controlling the light emitting element 30 to emit light; that is, the driving current flowing through the light emitting element 30 should be the sum of the first driving current and the second driving current.

It should be noted that the difference between the main driving transistor and the compensation transistor is that the driving voltage subjected to the main driving transistor is significantly larger than the driving voltage subjected to the compensation transistor. Therefore, the driving current generated by the main driving transistor will be significantly larger than the driving current generated by the compensation transistor.

Based on the pixel driving circuit described above, in order to achieve precise control of the compensation current, the pixel driving circuit may further include a current detecting module 40, connected between the first power signal terminal VDD1 and the second power signal terminal VDD2 and configured to detect the driving current flowing through the light emitting element 30.

For example, the current detecting module 40 may specifically include a current reading unit 400 configured to read the magnitude of the driving current, and a detecting switching element T3 configured to transmit the driving current to the current reading unit 400 within a preset period of time. In this arrangement, the control terminal of the detecting switch element T3 is coupled to the scan signal terminal Scan, the first terminal is coupled to the first power signal terminal VDD1, and the second terminal is coupled to the current reading unit 400, and can be configured to be turned on in response to the scan signal to transmit the driving current to the current reading unit 400; the other terminal of the current reading unit 400 is coupled to the second power signal terminal VDD2.

It should be noted that, since the first power signal terminal VDD1 is directly coupled to the first terminals of the first driving transistor DT1 and the second driving transistor DT2, the current detected by the current detecting module 40 through the first power signal terminal VDD1 is the total driving current flowing through the light emitting element 30.

In this way, the current detecting module 40 can detect the driving current actually flowing through the light emitting element 30. On the basis of this, the voltage of the first data signal and/or the voltage of the second data signal can be adjusted according to the magnitude of the detected driving current. For example, when the detected driving current is less than a preset driving current, the voltage of the first data signal can be increased and/or the voltage of the second data signal can be increased, therefore achieving compensation for the driving current.

Based on this, the pixel driving circuit may further include a compensation module coupled to the current detecting module 40 and configured to receive the driving current detected by the current detecting module 40, and adjust the voltage of the second data signal in a first stage according to the driving current, and adjust the voltage of the first data signal in a second stage.

It should be noted that the first stage refers to the stage where the first driving module 10 is used as the main driving circuit and the second driving module 20 is used as the compensation circuit, and the second stage refers to the stage where the second driving module 20 is used as the main driving circuit, and the first driving module 10 is used as the compensation circuit.

In the arrangement, in the case that the first driving module 10 is used as the main driving circuit and the second driving module 20 is used as the compensation circuit, the driving voltage (for example, the voltage of the first data signal) of the first driving module 10 may not be changed, and only the driving voltage (for example, the voltage of the second data signal) of the second driving module 20 may be adjusted, so that the second driving current compensates for the first driving current, therefore providing a stable driving current for the light emitting element 30; similarly, the second driving module 20 is used as the main driving circuit and the first driving module 10 is used as the compensation circuit, the driving voltage (for example, the voltage of the second data signal) of the second driving module 20 may not be changed, and only the driving voltage (for example, the voltage of the first data signal) of the first driving module 10 may be adjusted, so that the first driving current compensates for the second driving current to provide a stable driving current for the light emitting element 30.

In this way, since the driving voltage subjected to the driving transistor of the main driving circuit is relatively large, and the driving voltage subjected to the driving transistor of the compensation circuit is relatively small, adjusting (usually increasing) a relatively small driving voltage has less effect on the threshold voltage of the driving transistor without leading to its threshold voltage drift to deteriorate rapidly. Therefore, the display abnormality caused by the threshold voltage drift can be fundamentally solved, therefore ensuring the stability of the display product and prolonging the service life thereof.

Based on the above-described pixel driving circuit, the light emitting element 30 may be an OLED or a PLED (Polymer Light Emitting Diode) and the other terminal of the light emitting element 30 is coupled to a third power signal terminal GND. Considering that the synthesis and purification of the small molecule material is relatively easy, the process is relatively stable, and the colorization is easy to achieve, the OLED is preferably used as the light emitting element 30 in this arrangement.

In this arrangement, all of the transistors and the switching elements may use field effect transistors such as MOS (Metal-Oxide-Semiconductor) transistors, and in particular, may use N-type MOS transistors or P-type MOS transistors.

It should be noted that the control terminal described in this exemplary arrangement may be a gate of a transistor, and the first terminal and the second terminal may be respectively a source and a drain of the transistor, and the source and the drain are interchangeable. In addition, the transistor may be an enhancement transistor or a depletion transistor, which is not limited herein.

Figure 3:
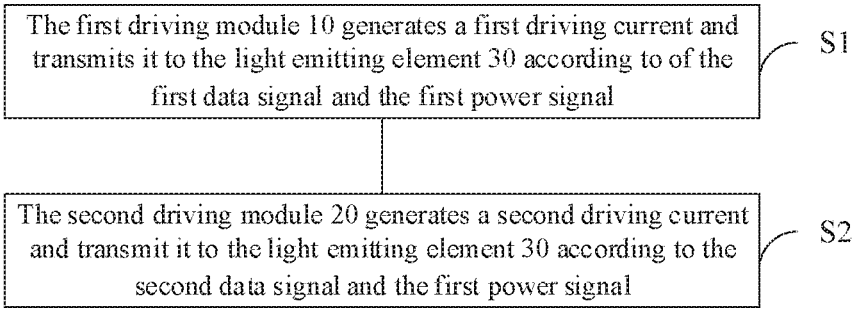
FIG. 3 schematically shows a flowchart of a pixel driving method in an exemplary arrangement of the present disclosure.

The exemplary arrangement also provides a pixel driving method configured to drive the pixel driving circuit described above. As shown in FIG. 3, the pixel driving method may include the following blocks.

In block S1, the first driving module 10 generates a first driving current and transmits it to the light emitting element 30 under the action of the first data signal and the first power signal; and In block S2, the second driving module 20 generates a second driving current and transmit it to the light emitting element 30 under the action of the second data signal and the first power signal.

In this arrangement, the first driving module 10 and the second driving module 20 are time-divisionally switched to serve as a main driving module for controlling the light emitting element to emit light. That is, the first driving module 10 and the second driving module 20 are alternately used as a main driving module and a compensation module for controlling the light emitting elements 30 to emit light at different stages.

The pixel driving method provided by the exemplary arrangement of the present disclosure alternates the first driving module 10 and the second driving module 20 as a main driving circuit and a compensation circuit, so that real-time current compensation can be performed on the light emitting pixels. On the one hand, by providing a stable driving current for the light emitting element 30, the stability and uniformity of the luminance can be ensured, therefore improving the display quality of the display device; on the other hand, by alternately using the two driving modules as the main driving circuit, the threshold voltage drift problem of the driving transistor can be fundamentally solved, therefore prolonging the service life of the display product.

In the present exemplary arrangement, the first driving module 10 may include a first driving transistor DT1, the second driving module 20 may include a second driving transistor DT2, and the first driving transistor DT1 and the second driving transistor DT2 may be used alternatively as the main driving transistor and the compensating transistor at different stages. As such, the first driving current and the second driving current can alternatively be used as a driving current for controlling the light emitting element 30 to emit light, that is, the driving current flowing through the light emitting element 30 should be the sum of the first driving current and the second driving current. It should be noted that the first driving module 10 and the second driving module 20 in this arrangement may both adopt a driving circuit with a 2T1C structure, but not limited thereto, and other driving circuits with other structures may be used as long as they can be implemented the driving function.

Figure 4:
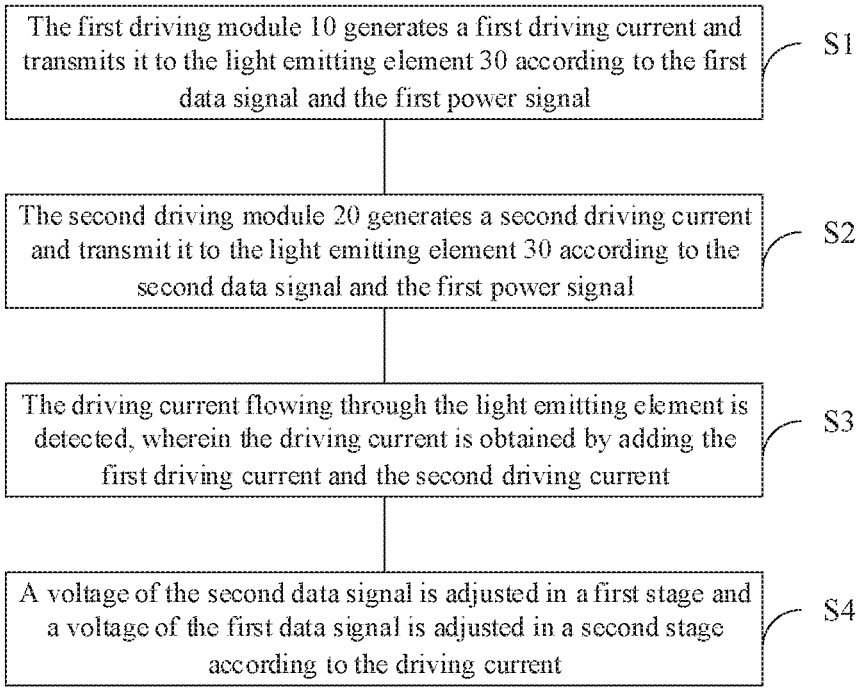
FIG. 4 schematically shows another flowchart of the pixel driving method in an exemplary arrangement of the present disclosure.

In the above-described pixel driving method, in order to achieve precise control of the compensation current, as shown in FIG. 4, the pixel driving method may further include the following blocks.

In block S3, the driving current flowing through the light emitting element is detected, wherein the driving current is obtained by adding the first driving current and the second driving current.

In block S4, a voltage of the second data signal in a first stage is adjusted according to the driving current, and a voltage of the first data signal in a second stage is adjusted.

In this arrangement, the first stage refers to the stage where the first driving transistor DT1 is used as the main driving transistor and the second driving transistor DT2 is used as the compensation transistor, and the second stage refers to the stage where the second driving transistor DT2 is used as the main driving transistor and the first driving transistor DT1 is used as the compensation transistor.

For example, the specific process of block S4 may include the following blocks.

In block S4-1, the voltage of the first data signal is maintained constant and the voltage of the second data signal is adjusted (for example, increasing) in the first stage according to the detected driving current, so that the second driving current is used as a compensation current for the first driving current.

In block S4-2, the voltage of the second data signal is maintained constant and the voltage of the first data signal is adjusted (for example, increasing) in the second stage, so that the first driving current is used as a compensation current for the second driving current.

In this way, since the driving voltage subjected to the driving transistor of the main driving circuit is relatively large, and the driving voltage subjected to the driving transistor of the compensation circuit is relatively small, adjusting (usually increasing) a relatively small driving voltage has less effect on the threshold voltage of the driving transistor without leading to its threshold voltage drift to deteriorate rapidly. Therefore, the display abnormality caused by the threshold voltage drift can be fundamentally solved, therefore ensuring the stability of the display product and prolonging the service life thereof.

It should be noted that the specific details of the pixel driving method and the implementation manner thereof have been described in detail in the corresponding pixel driving circuit, and details are not described herein again.

Figure 5:
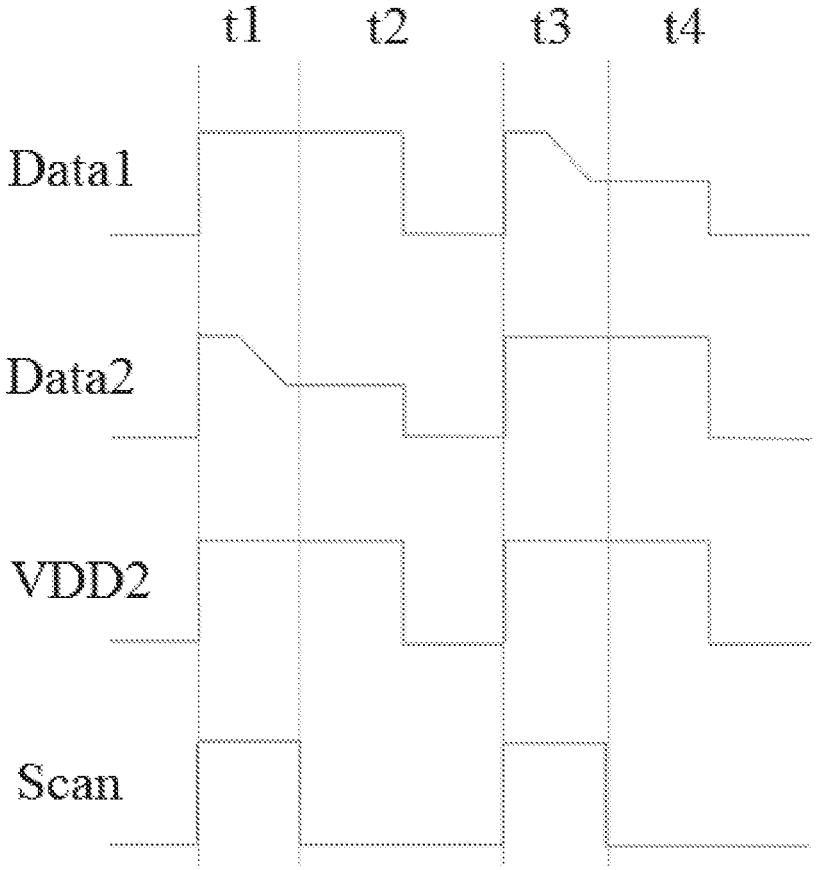
FIG. 5 schematically shows a signal timing diagram of a pixel driving circuit in an exemplary arrangement of the present disclosure.

The pixel driving method will be exemplarily described in a specific arrangement with reference to the accompanying drawings. In this arrangement, the structure of the pixel driving circuit can be referred to FIG. 2, and all of the transistors and the switching elements can adopt an N-type MOS transistor. FIG. 5 is a signal timing diagram of the pixel driving method. Based on this, the working principle of the pixel driving method can be described as follows.

In the stage "t1," the scan signal provided by the scan signal terminal Scan is at a high level, and the first switching element T1, the second switching element T2, and the detecting switching element T3 are all in an on state; the first data signal provided by the first data signal terminal Data1 is at a high level, and the first data signal charges the first node N1 through the first switching element T1 to bring the first node N1 to a high level; under the action of the first node N1, the first driving transistor DT1 is turned on and generates a first driving current; the second data signal provided by the second data signal terminal Data2 is gradually reduced from a high level to a suitable level, and the second data signal charges the second node N2 through the second switching element T2. The second driving transistor DT2 is turned on under the action of the second node N2 to generate a second driving current; at this time, the driving current flowing through the OLED light emitting element 30 is detected by the current detecting module 40, and according to the detected current the voltage of the second data signal is adjusted to achieve a stable current output to drive the OLED to emit light; at this stage, the gate voltage of the first driving transistor DT1 is the main driving voltage at a high level, and the gate voltage of the second driving transistor DT2 is a compensation driving voltage, which is much lower than the main driving voltage.

In the stage "t2," the scan signal provided by the scan signal terminal Scan is at a low level, the first switching element T1, the second switching element T2, and the detecting switching element T3 are all in an off state; the first node N1 and the second node N2 remain at a high level due to the action of the first capacitor C1 and the second capacitor C2, so that the first driving transistor DT1 and the second driving transistor DT2 can be kept in an on state, therefore maintaining the OLED light emitting element 30 to emit light normally.

In the stage "t3," the scan signal provided by the scan signal terminal Scan is at a high level, and the first switching element T1, the second switching element T2, and the detecting switching element T3 are all in an on state; the second data signal provided by the second data signal terminal Data2 is at a high level, and the second data signal charges the second node N2 through the second switching element T2 to bring the second node N2 to a high level; under the action of the second node N2, the second driving transistor DT2 is turned on and generates a second driving current; the first data signal provided by the first data signal terminal Data1 is gradually reduced from a high level to a suitable level, and the first data signal charges the first node N1 through the first switching element T1. The first driving transistor DT1 is turned on under the action of the first node N1 to generate a first driving current; at this time, the driving current flowing through the OLED light emitting element 30 is detected by the current detecting module 40, and according to the detected current, the voltage of the first data signal is adjusted to achieve a stable current output to drive the OLED to emit light; at this stage, the gate voltage of the second driving transistor DT2 is the main driving voltage at a high level, and the gate voltage of the first driving transistor DT1 is a compensation driving voltage, which is much lower than the main driving voltage.

In the stage "t4," the scan signal provided by the scan signal terminal Scan is at a low level, and the first switching element T1, the second switching element T2, and the detecting switching element T3 are all in an off state; the first node N1 and the second node N2 remain at a high level due to the action of the first capacitor C1 and the second capacitor C2, so that the first driving transistor DT1 and the second driving transistor DT2 can be kept in an on state, therefore maintaining the OLED light emitting element 30 to emit light normally.

The above stages are repeatedly switched, so that the first driving transistor DT1 and the second driving transistor DT2 are alternately used as the main driving transistor and the compensation driving transistor, therefore providing a constant driving current for the OLED light emitting element 30 to ensure stable display of the OLED device. On the basis of this, due to the mutual switching of the first driving transistor DT1 and the second driving transistor DT2, the operating time of the gate voltage and the operating voltage are reduced in turn, therefore effectively improving the threshold voltage drift phenomenon of the driving transistor to prolong the service life of the OLED device.

The exemplary arrangement also provides a display device including the above-described pixel driving circuit. The display device may include: a plurality of scan lines configured to provide scan signals; a plurality of data lines configured to provide data signals; and a plurality of pixel driving circuits electrically coupled to the scan lines and the data lines; wherein at least one of the pixel driving circuits includes any of the above-described pixel driving circuits in the present exemplary arrangement.

In the present disclosure, the display device may include any product or component having a display function, such as a mobile phone, a tablet computer, a television, a notebook computer, a digital photo frame, a navigator, and the like.

The pixel driving circuit and the driving method thereof provided by the exemplary arrangements of the present disclosure alternately use the first driving module and the second driving module as the main driving circuit and the compensation circuit, so that real-time current compensation can be performed on the light emitting pixels. On the one hand, by providing a stable driving current for the light emitting element 30, the stability and uniformity of the luminance can be ensured, therefore improving the display quality of the display device; on the other hand, by alternately using the two driving modules as the main driving circuit, the threshold voltage drift problem of the driving transistor can be fundamentally solved, therefore prolonging the service life of the display product.

Other arrangements of the present disclosure will be readily apparent to those skilled in the art upon consideration of the specification and practice of the present disclosure herein disclosed herein. The present application is intended to cover any variations, uses, or adaptations of the present disclosure, which are in accordance with the general principles of the present disclosure and include common general knowledge or conventional technical means in the art that are not disclosed in the present disclosure. The specification and examples are to be considered as illustrative only, the true scope and spirit of the present disclosure is pointed out by the following claims.

It should be understood that the present disclosure is not limited to the precise structure that has been described above and illustrated in the drawings, and various modifications and changes can be made without departing from the scope thereof. The scope of the present disclosure is limited only by the appended claims.

What is claimed is:

1. A pixel driving circuit, comprising a first driver, a second driver, and a light emitting element coupled to both the first driver and the second driver;

wherein the first driver is configured to generate a first driving current, the second driver is configured to generate a second driving current, and the light emitting element is driven by the first driving current and the second driving current alternately to be a main driving current and a compensation current, wherein the compensation current is smaller than the main driving current and greater than zero, wherein when the light emitting element is driven by one of the first driving current and the second driving current to be the main driving current, the other of the first driving current and the second driving current is taken as the compensation current to compensate for the one of the first driving current and the second driving current, wherein the first driver comprises:

a first switching element having a control terminal coupled to a scan signal terminal, a first terminal coupled to a first data signal terminal, and a second terminal coupled to a first node, and configured to transmit a first data signal to the first node in response to a scan signal;

a first driving transistor having a control terminal coupled to the first node, a first terminal coupled to a first power signal terminal, and a second terminal coupled to a first terminal of the light emitting element, and configured to generate the first driving current and transmit the first driving current to the light emitting element under an action of the first node and a first power signal; and a first storage device, connected between the first node and the first power signal terminal, wherein the second driver comprises:

a second switching element having a control terminal coupled to the scan signal terminal, a first terminal coupled to a second data signal terminal, and a second terminal coupled to a second node, and configured to transmit a second data signal to the second node in response to the scan signal;

a second driving transistor having a control terminal coupled to the second node, a first terminal coupled to the first power signal terminal, and a second terminal coupled to the light emitting element, and configured to generate the second driving current and transmit the second driving current to the light emitting element under an action of the second node and the first power signal; and a second storage device, connected between the second node and the first power signal terminal, wherein the pixel driving circuit further comprises:

a current detecting circuit, coupled to the first power signal terminal and configured to detect a driving current flowing through the light emitting element, wherein at least one of a voltage of the first data signal and a voltage of the second data signal are adjusted according to the driving current flowing through the light emitting element, wherein the pixel driving circuit further comprises:

a compensation circuit, coupled to the current detecting circuit and configured to receive a driving current detected by the current detecting circuit, and configured to adjust the voltage of the second data signal in a first stage according to the driving current detected by the current detecting circuit, and adjust the voltage of the first data signal in a second stage according to the driving current detected by the current detecting circuit, and wherein the first stage is a stage in which the first driving current is used to be the main driving current while the second driving current is used to be the compensation driving current, and the second stage is a stage in which the second driving current is used to be the main driving current while the first driving current is used to be the compensation driving current, wherein when the first driving current is used as the main driving current, the first driving current is greater than the second driving current, and when the second driving current is used as the main driving current, the second driving current is greater than the first driving current.

2. The pixel driving circuit according to claim 1, wherein a driving current of the light emitting element is a sum of the first driving current and the second driving current.

3. The pixel driving circuit according to claim 1, wherein when the first driving current is used as the main driving current, a driving voltage of the first driver is greater than a driving voltage of the second driver, and when the second driving current is used as the main driving current, the driving voltage of the second driver is greater than the driving voltage of the first driver.

4. The pixel driving circuit according to claim 1, wherein the current detecting circuit comprises:

a current reading circuit, configured to read a magnitude of the driving current flowing through the light emitting element; and a detecting switching element having a control terminal coupled to the scan signal terminal, a first terminal coupled to the first power signal terminal, and a second terminal coupled to a first terminal of the current reading circuit, and configured to transmit the driving current flowing through the light emitting element to the current reading circuit in response to the scan signal;

wherein, a second terminal of the current reading circuit is coupled to a second power signal terminal.

5. The pixel driving circuit according to claim 1, wherein the first and second driving transistors and the switching elements are either N-type transistors or P-type transistors.

6. The pixel driving circuit according to claim 1, wherein the first storage device and the second storage device each comprise a capacitor.

7. The pixel driving circuit according to claim 1, wherein the light emitting element is an organic light emitting diode;

wherein, a second terminal of the light emitting element is coupled to a third power signal terminal.

8. A pixel driving method, configured to drive a pixel driving circuit comprising a first driver, a second driver, and a light emitting element coupled to both the first driver and the second driver; the pixel driving method comprising:

generating and transmitting a first driving current to the light emitting element by the first driver under an action of a first data signal and a first power signal; and generating and transmitting a second driving current to the light emitting element by the second driver under an action of a second data signal and the first power signal;

wherein the first driving current and the second driving current are alternately used as a main driving current and a compensation current to drive the light emitting element, wherein the compensation current is smaller than the main driving current and greater than zero, wherein when the light emitting element is driven by a first one of the first driving current and the second driving current as the main driving current, a second one of the first driving current and the second driving current is taken as the compensation current to compensate for the first one of the first driving current and the second driving current, wherein the first driver comprises:

a first switching element having a control terminal coupled to a scan signal terminal, a first terminal coupled to a first data signal terminal, and a second terminal coupled to a first node, and configured to transmit a first data signal to the first node in response to a scan signal;

a first driving transistor having a control terminal coupled to the first node, a first terminal coupled to a first power signal terminal, and a second terminal coupled to a first terminal of the light emitting element, and configured to generate the first driving current and transmit the first driving current to the light emitting element under an action of the first node and a first power signal; and a first storage device, connected between the first node and the first power signal terminal, wherein the second driver comprises:

a second switching element having a control terminal coupled to the scan signal terminal, a first terminal coupled to a second data signal terminal, and a second terminal coupled to a second node, and configured to transmit a second data signal to the second node in response to the scan signal;

a second driving transistor having a control terminal coupled to the second node, a first terminal coupled to the first power signal terminal, and a second terminal coupled to the light emitting element, and configured to generate the second driving current and transmit the second driving current to the light emitting element under an action of the second node and the first power signal; and a second storage device, connected between the second node and the first power signal terminal, wherein the pixel driving method further comprises:

detecting a driving current flowing through the light emitting element, wherein the driving current flowing through the light emitting element is obtained by adding the first driving current and the second driving current; and adjusting a voltage of the second data signal in a first stage according to the driving current flowing through the light emitting element, and adjusting a voltage of the first data signal in a second stage, and wherein the first stage is a stage in which the first driving current is used to be the main driving current while the second driving current is used to be the compensation driving current, and the second stage is a stage in which the second driving current is used to be the main driving current while the first driving current is used to be the compensation driving current, wherein when the first driving current is used as the main driving current, the first driving current is greater than the second driving current, and when the second driving current is used as the main driving current, the second driving current is greater than the first driving current.

9. The pixel driving method according to claim 8, wherein a driving current of the light emitting element is a sum of the first driving current and the second driving current.

10. The pixel driving method according to claim 8, wherein the adjusting a voltage of the second data signal in the first stage according to the driving current flowing through the light emitting element, and adjusting a voltage of the first data signal in the second stage comprises:

keeping the voltage of the first data signal constant and adjusting the voltage of the second data signal in the first stage according to the driving current flowing through the light emitting element, and using the second driving current as a compensation current for the first driving current; and keeping the voltage of the second data signal constant and adjusting the voltage of the first data signal in the second stage according to the driving current flowing through the light emitting element, and using the first driving current as the compensation current for the second driving current.

11. A display device, comprising:

a pixel driving circuit comprising a first driver, a second driver, and a light emitting element coupled to both the first driver and the second driver;

wherein the first driver is configured to generate a first driving current, the second driver is configured to generate a second driving current, and the light emitting element is driven by the first driving current and the second driving current alternately to be a main driving current and a compensation current, wherein the compensation current is smaller than the main driving current and greater than zero, wherein when the light emitting element is driven by one of the first driving current and the second driving current to be the main driving current, the other of the first driving current and the second driving current is taken as the compensation current to compensate for the one of the first driving current and the second driving current, wherein the first driver comprises:

a first switching element having a control terminal coupled to a scan signal terminal, a first terminal coupled to a first data signal terminal, and a second terminal coupled to a first node, and configured to transmit a first data signal to the first node in response to a scan signal;

a first driving transistor having a control terminal coupled to the first node, a first terminal coupled to a first power signal terminal, and a second terminal coupled to a first terminal of the light emitting element, and configured to generate the first driving current and transmit the first driving current to the light emitting element under an action of the first node and a first power signal; and a first storage device, connected between the first node and the first power signal terminal, wherein the second driver comprises:

a second switching element having a control terminal coupled to the scan signal terminal, a first terminal coupled to a second data signal terminal, and a second terminal coupled to a second node, and configured to transmit a second data signal to the second node in response to the scan signal;

a second driving transistor having a control terminal coupled to the second node, a first terminal coupled to the first power signal terminal, and a second terminal coupled to the light emitting element, and configured to generate the second driving current and transmit the second driving current to the light emitting element under an action of the second node and the first power signal; and a second storage device, connected between the second node and the first power signal terminal, wherein the pixel driving circuit further comprises:

a current detecting circuit, coupled to the first power signal terminal and configured to detect a driving current flowing through the light emitting element, wherein at least one of a voltage of the first data signal and a voltage of the second data signal are adjusted according to the driving current flowing through the light emitting element, wherein the pixel driving circuit further comprises:

a compensation circuit, coupled to the current detecting circuit and configured to receive a driving current detected by the current detecting circuit, and configured to adjust the voltage of the second data signal in a first stage according to the driving current detected by the current detecting circuit, and adjust the voltage of the first data signal in a second stage according to the driving current detected by the current detecting circuit, and wherein the first stage is a stage in which the first driving current is used to be the main driving current while the second driving current is used to be the compensation driving current, and the second stage is a stage in which the second driving current is used to be the main driving current while the first driving current is used to be the compensation driving current, wherein when the first driving current is used as the main driving current, the first driving current is greater than the second driving current, and when the second driving current is used as the main driving current, the second driving current is greater than the first driving current.

* * * * *